US008371489B2

(12) United States Patent
Ogawa et al.

(10) Patent No.: US 8,371,489 B2
(45) Date of Patent: Feb. 12, 2013

(54) CYLINDRICAL CONTACT ARM HAVING A TAPERED GUIDE SECTION IN A POWER-DRIVEN NAILING MACHINE

(75) Inventors: Tatsushi Ogawa, Tokyo (JP); Norimitsu Sekiguchi, Tokyo (JP); Hiroki Yamamoto, Tokyo (JP)

(73) Assignee: Max Co., Ltd., Tokyo (JP)

( * ) Notice: Subject to any disclaimer, the term of this patent is extended or adjusted under 35 U.S.C. 154(b) by 984 days.

(21) Appl. No.: 10/564,761

(22) PCT Filed: Jun. 22, 2004

(86) PCT No.: PCT/JP2004/009069

§ 371 (c)(1),
(2), (4) Date: Jan. 17, 2006

(87) PCT Pub. No.: WO2005/007350

PCT Pub. Date: Jan. 27, 2005

(65) Prior Publication Data

US 2006/0169738 A1 Aug. 3, 2006

(30) Foreign Application Priority Data

Jul. 18, 2003 (JP) ..... P.2003-276431

(51) Int. Cl.
*B25C 1/04* (2006.01)

(52) U.S. Cl. ..... 227/119; 227/107; 227/130; 227/139

(58) Field of Classification Search ..... 227/107, 227/113, 119, 139, 130
See application file for complete search history.

(56) References Cited

U.S. PATENT DOCUMENTS

| | | | | | |
|---|---|---|---|---|---|
| 1,237,360 | A * | 8/1917 | Martin | 227/139 |
| 1,241,996 | A * | 10/1917 | Kristiansen | 227/139 |
| 3,636,707 | A * | 1/1972 | Saari et al. | 92/15 |
| 5,205,457 | A * | 4/1993 | Blomquist, Jr. | 227/66 |
| 5,263,842 | A * | 11/1993 | Fealey | 227/8 |
| 5,647,525 | A * | 7/1997 | Ishizawa | 227/113 |
| 6,145,727 | A * | 11/2000 | Mukoyama et al. | 227/130 |
| 6,578,750 | B2 * | 6/2003 | Kubo et al. | 227/142 |
| 6,695,196 | B2 * | 2/2004 | Hamada et al. | 227/119 |

FOREIGN PATENT DOCUMENTS

| | | |
|---|---|---|
| DE | 196 01 508 A1 | 7/1997 |
| JP | 51-119082 U | 9/1976 |
| JP | 59-146764 | 8/1984 |
| JP | 1-71079 | 5/1989 |
| JP | 5-78486 | 10/1993 |
| JP | A-2002-337066 | 11/2002 |

OTHER PUBLICATIONS

Supplementary European Search Report dated Mar. 5, 2008, for App. No. 04746538.
Japanese Office Action dated Nov. 1, 2007 along with English translation of same, for App. No. 2003-276431.

* cited by examiner

*Primary Examiner* — Lindsay Low
(74) *Attorney, Agent, or Firm* — Morgan, Lewis & Bockius LLP

(57) ABSTRACT

In a power-driven nailing machine for driving a nail disposed within a discharge port 7 of a nose body 6 into a work, a contact nose 13 giving a leading end discharge port 12 for guiding the nail driven from a discharge port 7 of the nose body 6 toward the work is provided to be protrusively urged toward the leading end of the nose body 6. In the leading end discharge port 12 of the contact nose 13, a guide portion 17, 19 longer than a maximum sized nail is formed from the leading end.

7 Claims, 7 Drawing Sheets

PRIOR ART

CYLINDRICAL CONTACT ARM HAVING A TAPERED GUIDE SECTION IN A POWER-DRIVEN NAILING MACHINE

TECHNICAL FIELD

The present invention relates to a nailing machine for driving a nail, supplied into a discharge port formed at a nose, into a work through a driver impactively driven by power such as compressed air. Particularly, the present invention relates to a driving guide mechanism for guiding the nail to be driven by the driver to the work.

BACKGROUND ART

For example, in the nailing machine using the compressed air as a power source, a hollow-cylindrical driving cylinder is arranged within a housing constituting a nailing machine body and a driving piston integrally coupled with a driver for striking the nail is slidably accommodated within the driving cylinder. By impactively driving the driving piston downward from an upper dead center position within the driving cylinder in such a manner that the compressed air is introduced into the driving cylinder, the nail is driven into the work by the driver coupled with the driving piston. Beneath the housing, a nose is integrally formed which serves to guide the driver slidably accommodated and forms a discharge port for guiding the nail to be driven by the driver. The driver coupled with the driving piston, which is accommodated in the discharge port, is slidably guided. By driving the driving piston, the driver coupled with the driving piston is impactively operated in the discharge port so as to strike the nail supplied into the discharge port, thereby driving the nail into the work from the discharge port.

As described above, in the power-driven nailing machine, which is provided with an impact mechanism for impactively driving the driver for striking the nail by the pressure of compressed air or combustion gas and serves to strike the nail by the driver driven through this impact mechanism so as to be driven into the work such as wood, concrete or steel plate, in reaction to impactively driving the driving piston coupled with the above driver within the driving cylinder, a reaction force in a direction opposite to the acting direction of the driving piston is generated within the housing accommodating the impact mechanism. By this reacting phenomenon, the nose integrally coupled with the housing will move upwards. As a result, the nail discharge port leaves the face of the work. Thus, the driver striking the head of the nail strays off from the nail head so that the face of the work is struck and damaged, thus generating a driver mark.

In order that the discharge port for driving/guiding the nail is not isolated from the face of the work even when the nailing machine body has moved upwards from the work because of the reaction during nail striking, the nailing machine has been proposed in which as shown in FIG. 7, a contact nose 31 is slidably provided at a leading end of a nose body 30 and the nail driven out from a discharge port 32 of the nose body 30 is vertically guided by a leading end discharge port 33 formed in the contact nose 31 thereby to drive the nail into the work (see JP-A-2002-337066). In this conventional nailing machine, the contact nose 31 giving the leading end discharge port 33 is held by the nose body 30 so that it is urged slidably along the discharge port 32 of the nose body 30 and protrusively forward from the nose body 30 in its leading end. So, even when the nose body 30 moves upward from the face of the work by reaction, the contact status between the contact nose 31 and the face of the work is kept, thereby preventing occurrence of the driver mark.

Meanwhile, in the nailing machine provided with the contact nose 31, in a state where the contact nose 31 has moved upward against the nose body 30 in order to actuate the nailing machine, the discharge port 32 of the nose body 30 and the discharge port of the contact nose 31 are formed to be continuous to each other. In this case, if the nose body 30 moves upwards by reaction in nail driving, between the leading end discharge port 33 of the contact nose 31 and the discharge port 32 of the nose body 30, a gap 34 having a larger inner diameter than that of these discharge ports will be generated. However, at the upper portion of the leading end discharge port 33 of the contact nose 31, a tapered guide face 35 is formed so that even when the gap 34 is generated as described above, the nail driven from the discharge port 32 of the nose body 30 can be smoothly guided into the leading end discharge port 33 of the contact nose 31.

Generally, the inner diameter of the discharge port of the nailing machine is formed to be slightly larger than that of the head of the nail. So the head H of the nail guided by the discharge port is located at the center of the discharge port whereas the leading end P thereof is placed in a free state within the discharge port. As a result, the nail with a shaft slanted may be driven. Since a concrete nail or steel plate nail N has a relatively short shaft, the slanting angle of the nail shaft may be large within the discharge port. Therefore, for the concrete nail, for example, in order to prevent the nail from slanting within the discharge port, a ring-shaped foot guide G is mounted at the leading end portion of the nail shaft so that the outer peripheral edge of the food guide G is engaged with the inner wall of the discharge port 32. Thus, the leading end P of the nail shaft is arranged at the center of the discharge port 32 so that the nail shaft is kept perpendicularly to the face of the work.

Where the concrete nail or steel plate nail with the foot guide G mounted at the leading end of its shaft as described above is driven through the above conventional contact nose 31, as seen from FIG. 7, the leading end P of the nail shaft is located at the center of the leading end discharge port 33 in such a manner that the foot guide G is fit on the inner periphery of the leading end discharge port 33 of the contact nose 31, whereas the head H thereof may be placed in a gap 34 having a larger inner diameter formed between the lower end of the nose body moved upward owing to reaction and the upper area of the leading end discharge port 33 of the contact nose 31. As a result, the nail N may be driven from the contact nose 31, while the head H of the nail N is deviated from the central position of the discharge port so that with the nail shaft being slanted.

DISCLOSURE OF THE INVENTION

In order to solve the problem of the prior art described above, the present invention intends to provide a nailing machine capable of preventing a driver mark from being generated even if reaction of the nailing machine occurs, and of driving a concrete nail or steel plate nail having a relatively short length without being slanted.

In order to solve the problem of the prior art described above, the present invention provides a power-driven nailing machine in which a driving piston is driven by causing the pressure of e.g. compressed air to act on the upper face of a driving piston slidably housed in a driving cylinder and a driver coupled with the driving piston is driven in a discharge port of a nose body so that the nail arranged within the discharge port of the nose body is driven from the discharge port into a work arranged at a leading end of the nose body, wherein a contact nose having a leading end discharge port for guiding the nail driven from the discharge port of the nose body toward the work is provided to be protrusively urged toward the leading end of the nose body, and the leading end discharge port of the contact nose has a guide portion from its leading end, having a length greater than that of a maximum sized nail.

The object of preventing a driver mark displacement due to reaction of the nailing machine and of driving a concrete nail or steel plate nail having a relatively short length without being slanted was realized by providing the contact nose having a leading end discharge port so as to be protrusively urged toward the leading end of the nose body, and by forming the straight guide portion having a length greater than that of the nail used in the nailing machine in the leading end discharge port of the contact nose.

In an illustrative embodiment, the power-driven nailing machine is adapted to drive at least one-sized nail into a work piece. In this embodiment, the power-driven nailing machine comprises a driving cylinder with a longitudinal axis, including a driving piston operable between first and second positions, the second position being spaced from the first position along the longitudinal axis. In this embodiment, the power-driven nailing machine includes a driver having first and second ends, the first end being connected to the driving piston, the second end having a first outer dimension transverse to the longitudinal axis.

Moreover, in this embodiment the power-driven nailing machine includes a nose body having third and fourth ends proximate the driving cylinder, the third end of the nose body being disposed between the driving cylinder and the fourth end of the nose body, the nose body including a first passage extending from the third end to the fourth end, the passage defining a first inner dimension transverse to the longitudinal axis of the driving cylinder, the first inner dimension being greater than the first outer dimension.

Further, in this embodiment, the power-driven nailing machine includes a contact nose having a leading end. The contact nose includes a hollow member with proximal and distal ends. In this embodiment, the hollow member defines inner and outer surfaces extending from the proximal end to the distal end. Additionally, in this embodiment the fourth end of the nose body is circumferentially received within the proximal end of the hollow member such that the nose body is slidable relative to the hollow member between third and fourth positions, the second end resting on a first portion of the inner surface at the fourth position and being spaced from the first portion of the inner surface at the third position. In this embodiment, the inner surface further includes a guide portion disposed between the fourth position and the distal end, the guide portion being configured and dimensioned to form a radial enclosure about the at least one-sized nail such that the radial enclosure aligns the at least one-sized nail with the longitudinal axis of the driving cylinder before the driver pushes the at least one-sized nail out the leading end of the contact nose into the work piece.

Additionally, in this embodiment the power-driven nailing machine includes a nail supply mechanism disposed between the driving cylinder and the fourth end of the nose body such that the nail supply mechanism supplies the at least one-sized nail to the nose body, the nail supply mechanism being configured and dimensioned to accommodate only nails having a length less than or equal to the distance measured along the longitudinal axis from the leading end of the contact nose to a farthest extent of the radial enclosure.

Also, the guide portion may include a tapered guide face, and the radial enclosure may have a straight guide portion. The power-driven nailing machine may further include a trigger such that actuating the trigger causes the driving piston to move from the first position to the second position. In this embodiment, the driver may extend through the passage in the nose body and into the contact nose when the driving piston is in the second position. Moreover, the contact nose may be movable relative to the nose body such that in one configuration the nose body blocks movement of the contact nose to actuate the trigger.

Figure 1:
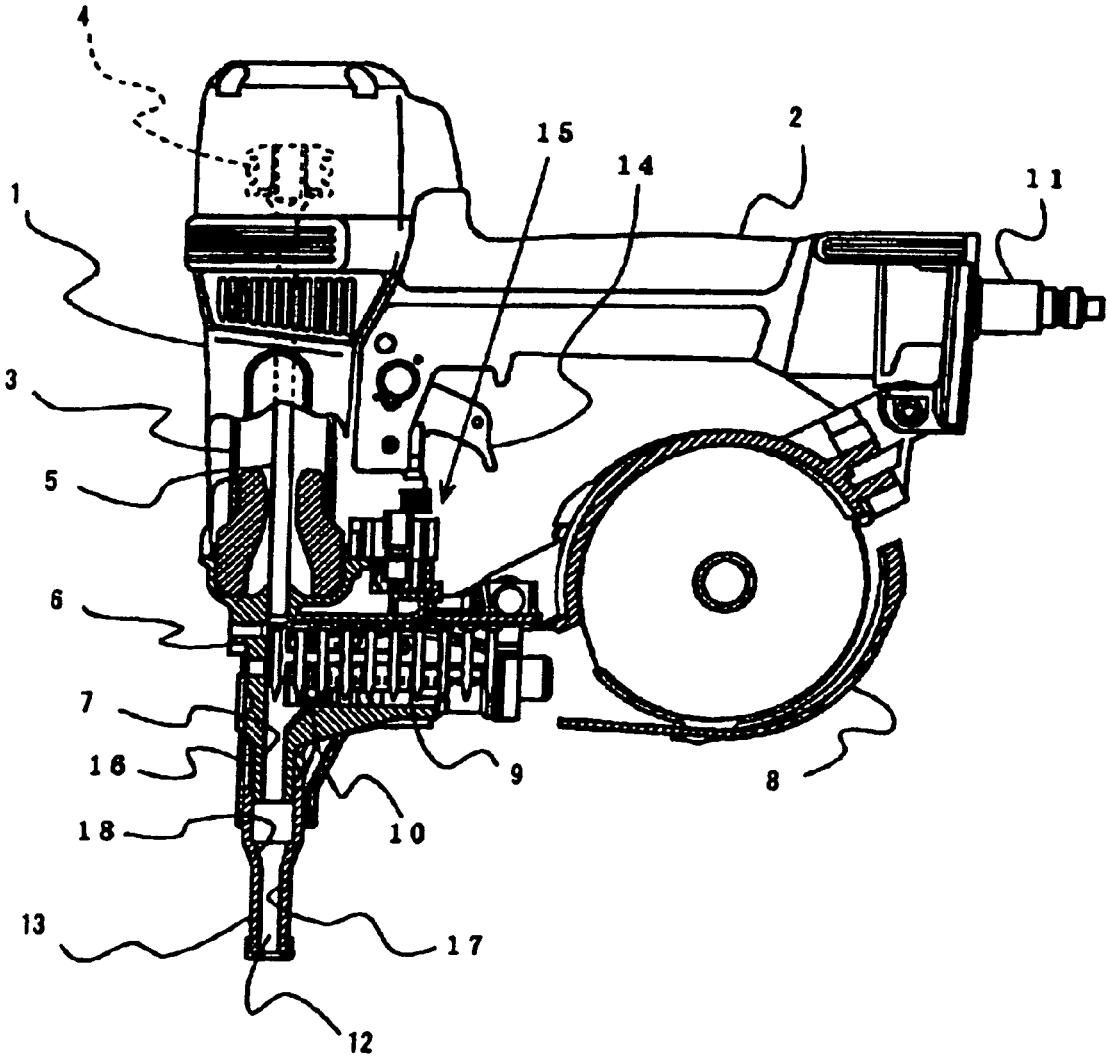
FIG. 1 is a side view of a nailing machine according to the first embodiment partially cut away.
Figure 2:
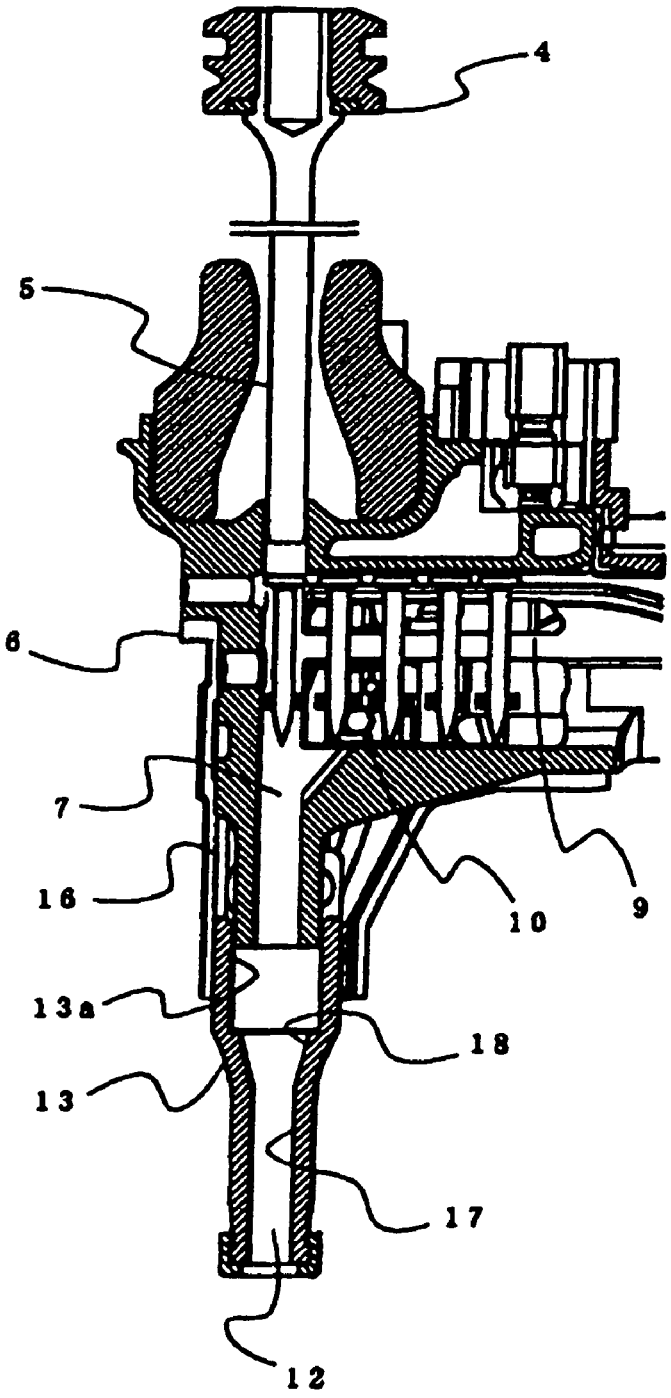
FIG. 2 is a sectional view of a driving guide mechanism of the nailing machine shown in FIG. 1.

Incidentally, reference numerals and signs in the drawings are as follows. Reference numeral 1 denotes a housing; 6 a nose body; 7 a discharge port; 12 a leading end discharge port; 13 a contact nose; 17 a straight guide portion; and 18 a tapered guide portion.

BEST MODE FOR CARRYING OUT THE INVENTION

First Embodiment

FIG. 1 shows a nailing machine equipped with a driving guide mechanism according to an embodiment of the present invention. Within a housing 1 constituting a nailing machine body integrally coupled with a grip 2, a hollow driving cylinder 3 is arranged. Within the driving cylinder 3, a driving piston 4 integrally coupled with a driver 5 for striking a nail is slidably accommodated. To the lower part of the housing 1, a nose body 6 constituting a hollow discharge port for driving/guiding the nail is attached. The other end of the driver 5 with the one end coupled with the driving piston 4 is projected from the lower end of the driving cylinder 3 so that the driver 5 is accommodated in the discharge port 7 of the nose body 6 and slidably guided. Behind the nose body 6, a nail supply guide 9 which supplies and guides a nail from a magazine 8 to the discharge port 7 is formed. By a nail supply mechanism 10 arranged along the nail supply guide 9, connected nails N housed in the magazine 8 are sequentially supplied to the discharge port 7 of the nose body 6.

Within the grip 2, an air chamber for accumulating compressed air is formed. Into the compressed air chamber, compressed air is supplied through a plug 11 attached to the rear end of the grip 2 from a compressed air source. Between the compressed air chamber and driving cylinder 3, a main valve is formed. Through this main valve, the compressed air within the compressed air chamber is introduced into the driving cylinder 3. By the pressure of this compressed air, the driving piston 4 is impactively driven from an upper dead center toward a lower dead center in the driving cylinder 3. The driver 5 coupled with the driving piston 4 is driven in the discharge port 7 of the nose body 6, thereby driving, from the discharge port 7, the nail supplied into the discharge port 7.

At the leading end side of the nose body 6, a hollow contact nose 13 having a leading end discharge port 12 continuous to the discharge port 7 of the nose body 6 is formed. At the upper portion of the contact nose 13, a cylindrical area 13*a* with a larger diameter is formed. By accommodating the lower end of the nose body 6 in the cylindrical area 13*a*, the contact nose 13 is held slidably along the discharge port 7 of the nose body 6. Further, the contact nose 13 as well as a trigger lever 14 formed at the base of the grip 2 constitutes a trigger mechanism 15 for triggering the nailing machine. The contact nose 13 is coupled with the lower end of a contact arm 16 with its upper end located in the vicinity of the trigger lever 14. By the urging force of the contact arm 16, the contact nose 13 is urged so as to be projected toward the leading end of the nose body 6. The trigger mechanism 15 is triggered by bringing the contact nose 13 into contact with the face of the work so that the contact nose 13 is slid to the nose body 6 and operating the trigger lever 14 formed at the base of the grip 2, thus actuating the nailing machine.

The contact nose 13 has a leading end discharge port 12 for leading or guiding the nail driven from the discharge port 7 of the nose body 6 toward the face of the work. On the leading end side of the leading end discharge port 12, a straight guide portion 17 having a slightly larger inner diameter than that of the head H of the nail N is formed. By this straight guide portion 17, the ring-shaped foot guide G mounted at the leading end P of the shaft of the nail N is guided in the leading end discharge port 12 so that the leading end P of the nail N is located at the center at the leading end of the leading end discharge port 12. Above the straight guide portion 17 constituting the leading end discharge port 12, a tapered guide face 18 with its inner diameter gradually increasing upwards is formed. The tapered guide face 18 serves to guide the nail driven from the discharge port 7 of the nose body 6 into the leading end discharge port 12.

Further, the length of the straight guide portion 17 of the leading end discharge port 12 of the contact nose 13 is made longer than a maximum sized nail which can be used in the nailing machine according to this embodiment. For this reason, when the leading end P of the nail N is driven out from the leading end of the leading end discharge port 12 of the contact nose 13 in contact with the work, the head H of the nail N can be located at the center position. Thus, with the leading of the nail N driven in the leading end discharge port 12 of the contact nose 13 by the driver 5 being landed on the surface of the work W, the leading end P and head H are placed within the length of the straight guide portion 17 so that the nail N is held in a vertical status. So the nail will not be driven in its slanted status.

Now referring to FIGS. 2 to 5, an explanation will be given of the state of the driving operation of the nail by the driving guide mechanism according to this embodiment. Before the nailing machine is actuated, as seen from FIG. 2, the driving piston 4 is located at the upper dead center of the driving cylinder, and the driver 5 coupled with the driving piston 4 stands by at a position above the nail supplied into the discharge port 7 of the nose body 6. The contact nose 13 is arranged protrusively toward the leading end of the discharge port 7 of the nose body 6.

Figure 3:
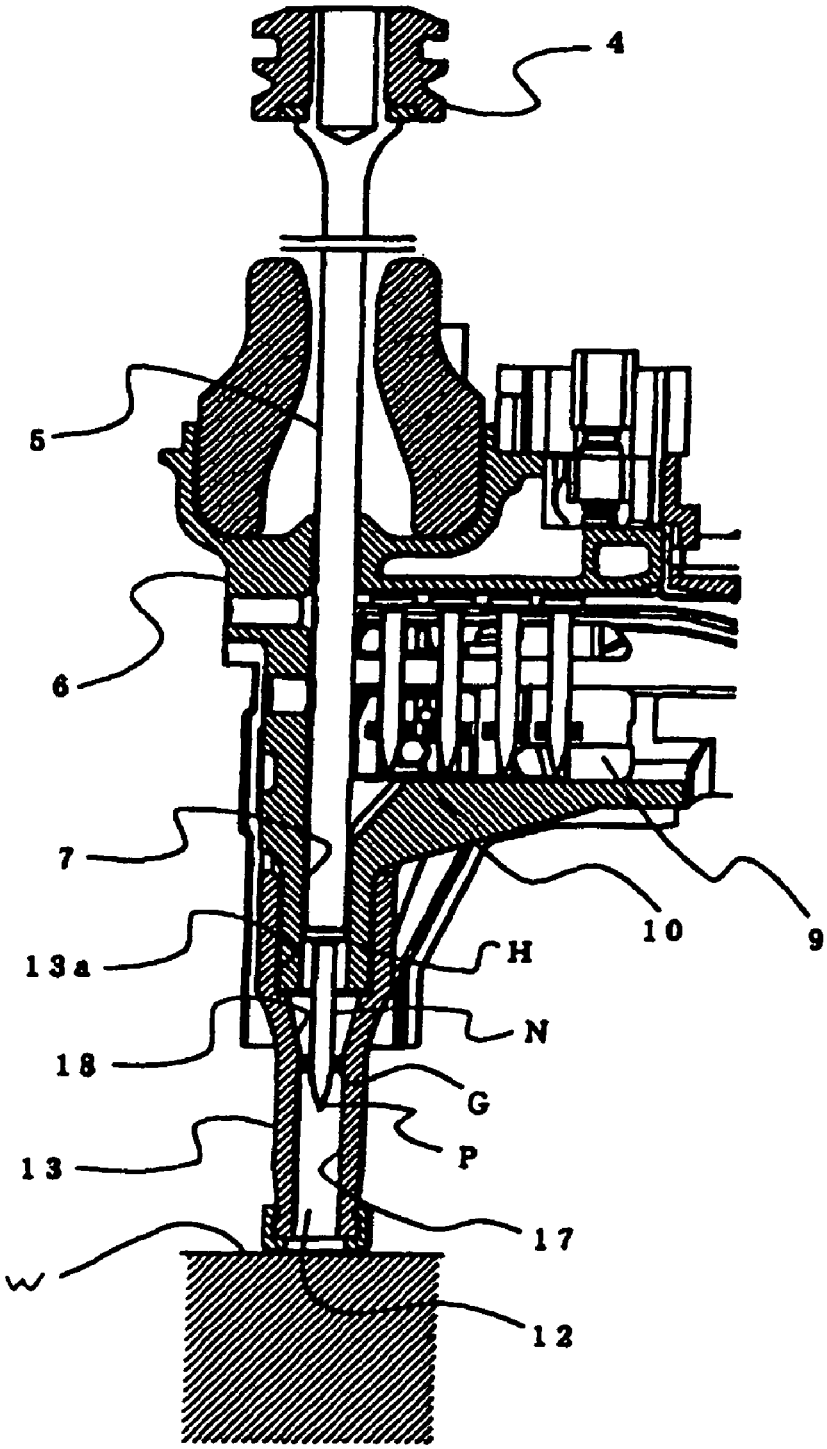
FIG. 3 is a sectional view of the driving guide mechanism in a state immediately after the nailing machine is actuated.

As seen from FIG. 3, by upward sliding the contact nose 13 in contact with the work W along the nose body 6 and operating the trigger lever 14 formed at the base of the grip 2, the trigger mechanism 15 is triggered. Then, the compressed air is introduced into the driving cylinder 3 so that the nailing machine is actuated. The driving piston 4 is driven by the pressure of the compressed air toward the lower dead center in the driving cylinder 3. Thus, the driver 5 coupled with the driving piston 4 is driven within the discharge port 7 of the nose body 6 to knock the nail N supplied into the discharge port 7 of the nose body 6, thereby driving the nail N from the discharge port 7 toward the leading end discharge port 12 of the contact nose 13.

Figure 4:
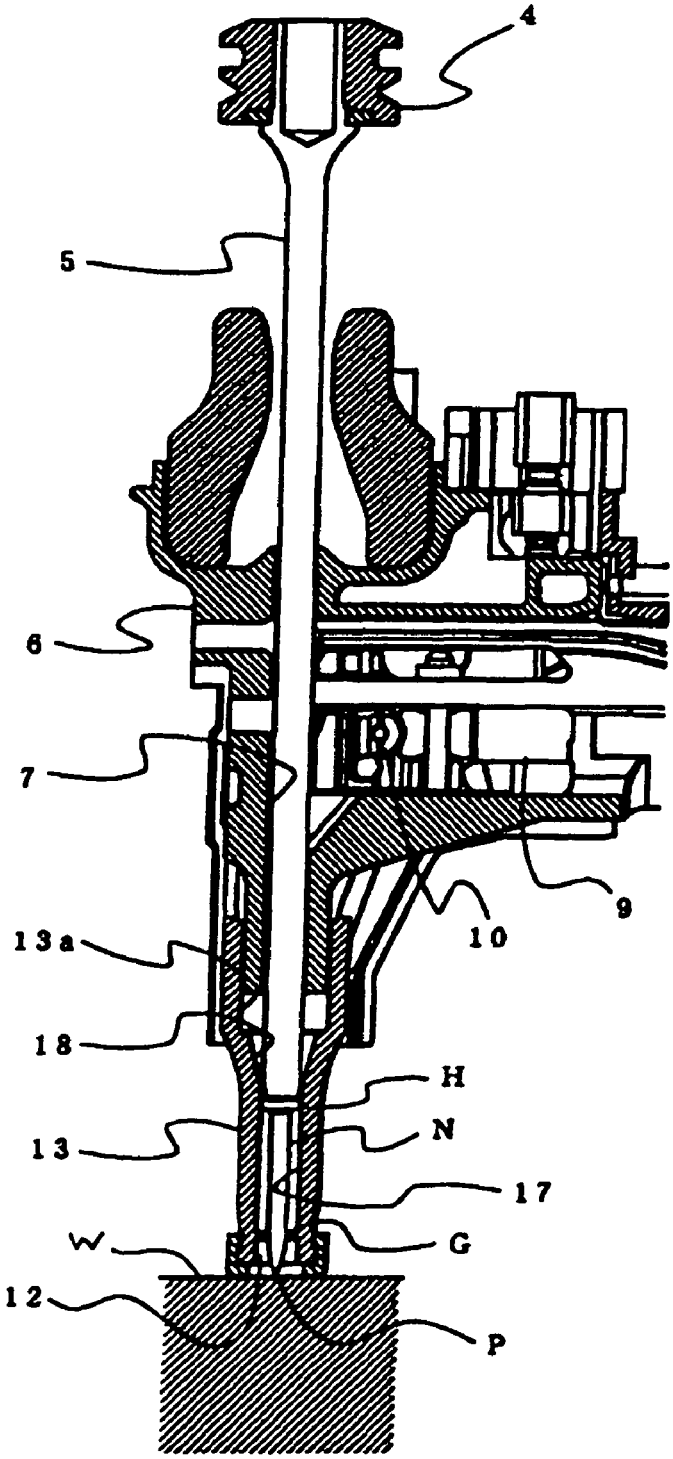
FIG. 4 is a sectional view of the driving guide mechanism in a state where a leading end of a nail is driven into a work.
Figure 5:
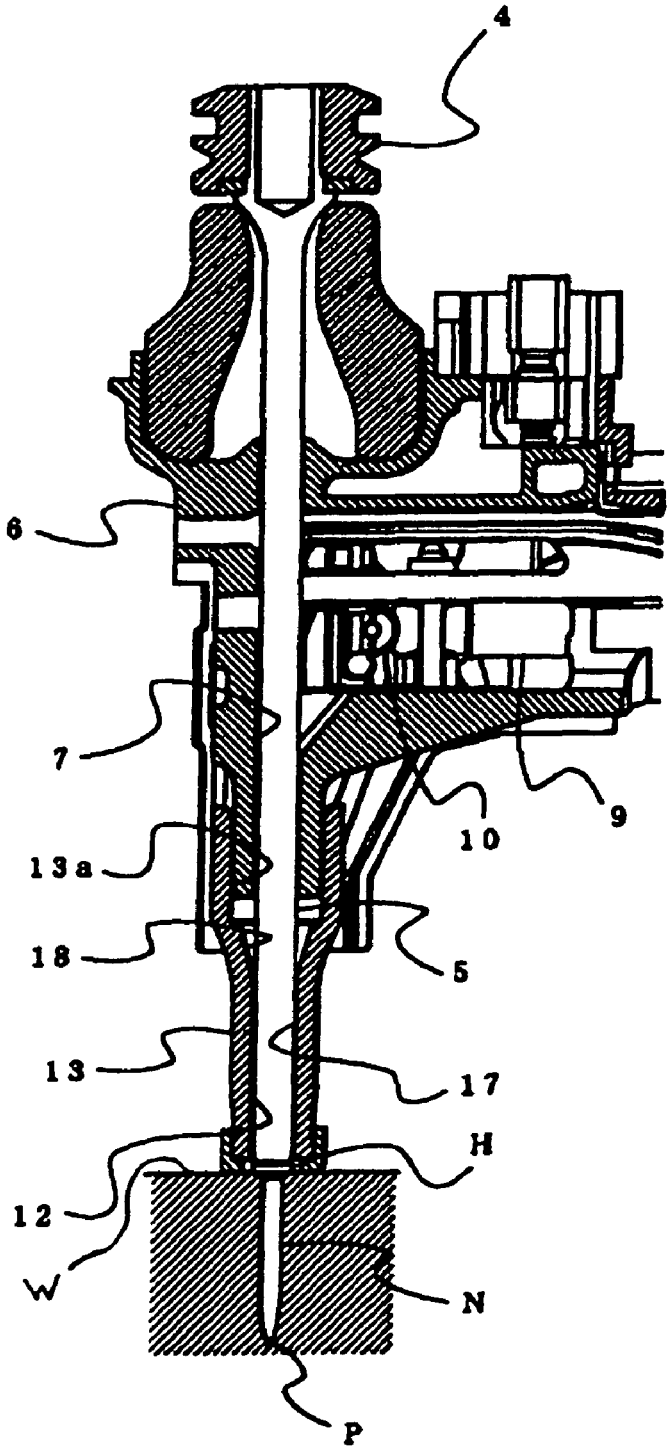
FIG. 5 is a sectional view of the driving guide mechanism in a state immediately after a nail has been driven into the work.

As seen from FIG. 4, the leading end of the contact nose 13 is kept in contact with the surface of the work W. And the nail driven from the discharge port 7 of the nose body 6 toward the leading end discharge port 12 of the contact nose 13 is guided by the tapered guide face 18 formed at the upper portion of the leading end discharge port 12 to enter the straight guide portion 17. The foot guide G mounted on the shaft of the nail near the leading end P thereof is guided onto the inner periphery of the straight guide portion 17 of the leading end discharge port 12 so that the leading end P of the nail N is kept at the center of the leading end discharge port 12. Further, when the leading end P of the nail N is driven in the work, the head H of the nail N reaches the straight guide portion 17 of the leading end discharge port 12 and is kept at the center of the leading end discharge port 12. So the nail shaft is guided vertically by the leading end discharge port 12 of the contact nose 13 so that the nail can be vertically driven into the work W.

The length of the straight guide portion 17 having a uniform inner diameter which gives the leading end discharge port 12 of the contact nose 13 is made greater than that of the maximum sized nail which is capable to be used in the nailing machine. For this reason, even where the gap having a larger inner diameter than that of the discharge port 7 and the leading end discharge port 13 is created between the contact nose 13 and the nose body 6 as a result that the nose body 6 moves upwards owing to reaction of the nailing machine, when the leading end of the nail driven out through guidance by the leading end discharge port 12 is driven into the work W from the contact nose 13, the leading end P and head H of the nail has reached the straight guide portion 17 of the leading end discharge port 12 of the contact nose 13. Thus, the nail head H is not located within the gap having the larger diameter and the nail shaft is not slanted. Accordingly, the nail can be vertically driven through the leading end discharge port 12 of the contact nose 13.

Second Embodiment

Figure 6:
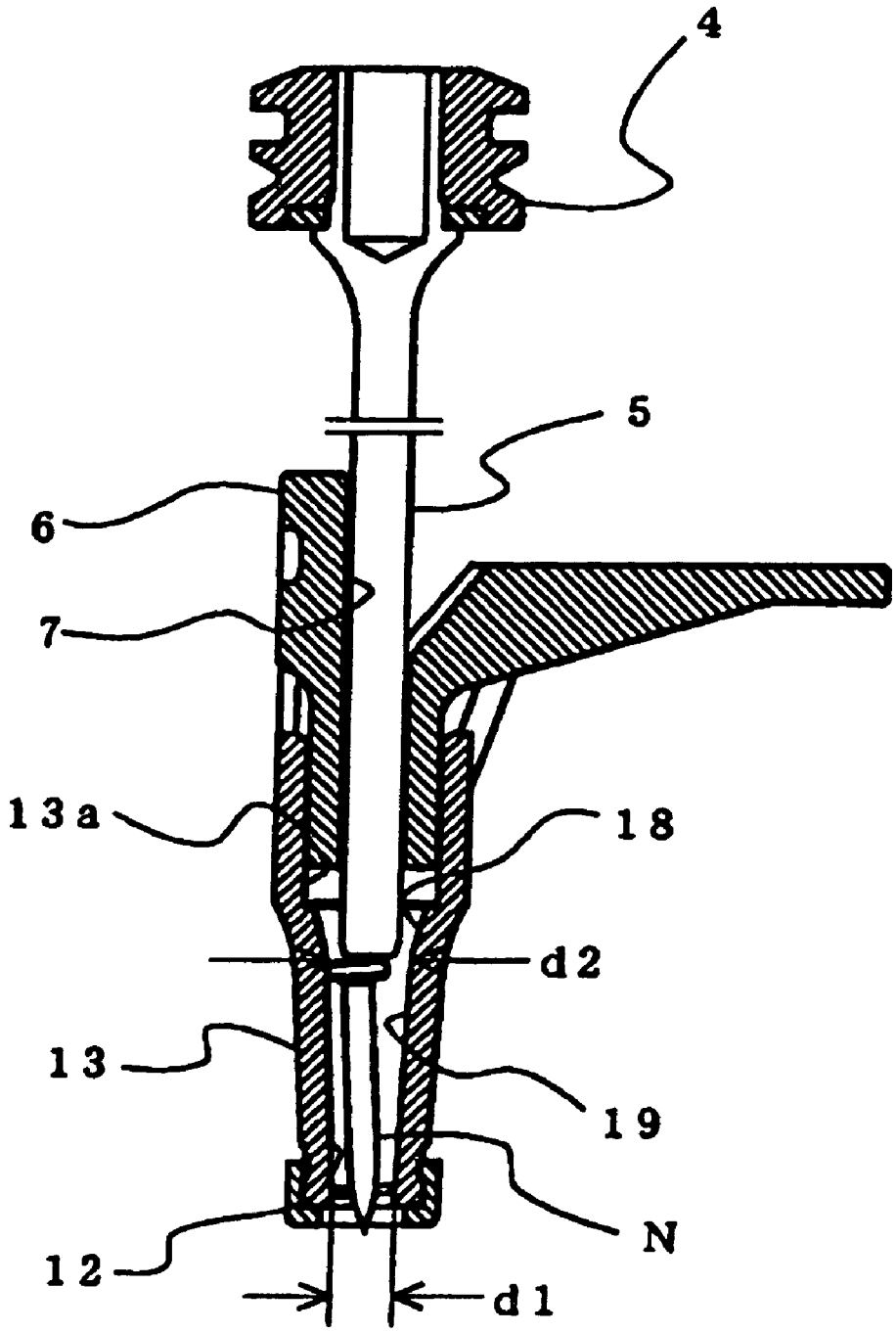
FIG. 6 is a sectional view of the driving guide mechanism of a nailing machine according to the second embodiment.
Figure 7:
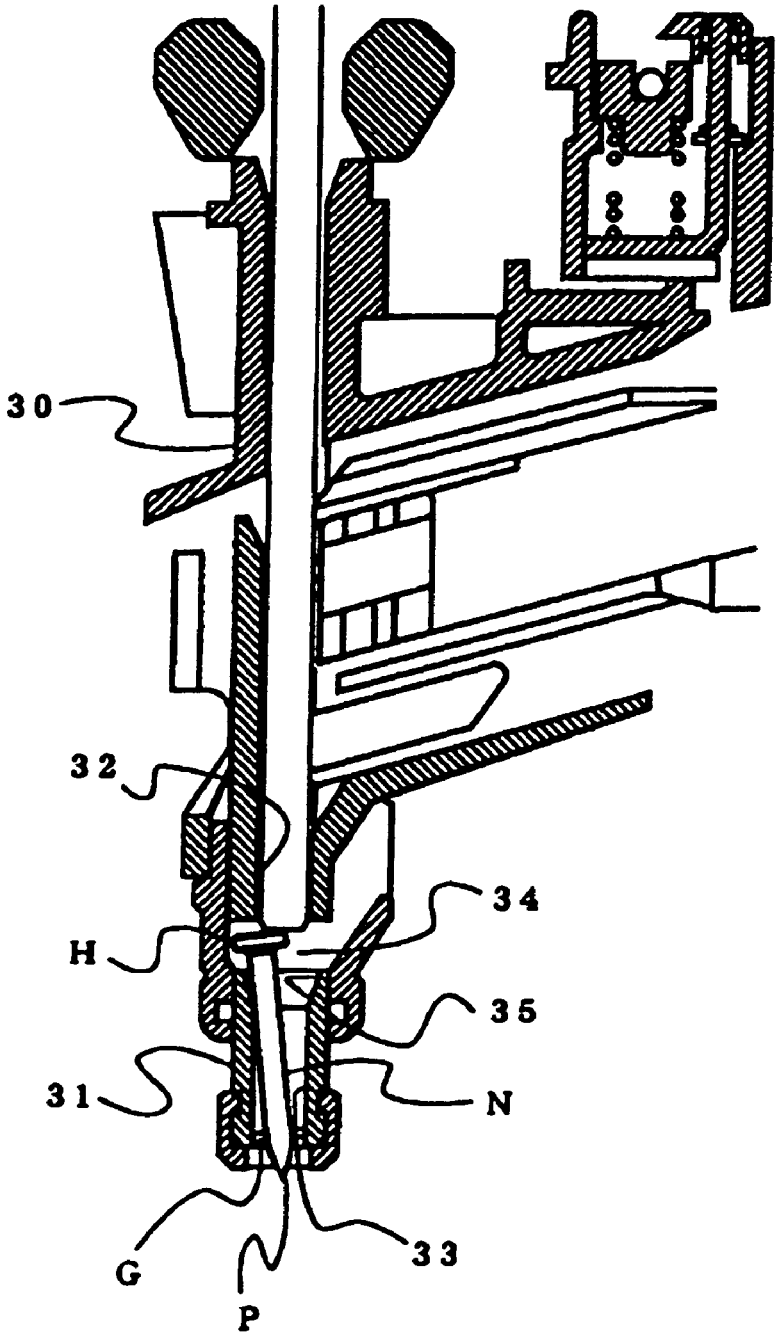
FIG. 7 is a sectional view of the state where the nail is slanted in a prior art nailing machine.

In the first embodiment, the inner periphery of the leading end discharge port 12 of the contact nose 13 is formed on the straight guide portion 17 between the leading end and the guide face 18. However, this invention requires that with the head H and foot guide G of the nail N being in point-contact with the inner periphery of the leading end discharge port 12, the shaft of the nail N can be guided to the virtual center of the leading end discharge port 12. For this reason, in the second embodiment as shown in FIG. 6, a tapered guide portion 19 (first guide portion 19) is formed to have an inner diameter increasing from the leading end of the leading end discharge port 12 to a guide face 18 (second guide portion 18) so that a difference between the inner diameter d1 at the leading end of the leading end discharge port 12 and the inner diameter d2 at the guide face 18 (second guide portion 18) thereof is about 1 mm to 3 mm.

Industrial Applicability:

The contact nose giving the leading end discharge port for guiding the nail driven from the discharge port of the nose body is provided to be protrusively urged toward the leading end of the nose body. For this reason, even where the nose body moves upward from the work owing to reaction, the leading end of the contact nose does not leave the surface of the work. This prevents the leading end of the driver from being deviated from the head of the nail and making the driver mark on the work. Further, the leading end discharge port of the contact nose is formed from the leading end by the guide portion longer than the maximum sized nail. For this reason, the entire length from the leading end to the head of the nail which is guided by the contact nose and driven is placed within the guide portion of the leading end discharge port. And the foot guide mounted at the leading end side of the shaft and the head side edge are guided by the inner periphery of the guide portion, and with the nail shaft being kept in a vertical state, the nail is driven from the contact nose into the work. This prevents the nail being slanted from being driven.

The invention claimed is:

1. A power-driven nailing machine comprising:

a driving cylinder;

a driving piston slidably housed within the driving cylinder;

a driver coupled with the driving piston;

a nose body having a lower end with a nail discharge port; and a contact nose arranged to be protrusively urged toward a leading end of the nose body, the contact nose having an upper end and a leading end, including a cylindrical portion formed at its upper portion such that the cylindrical portion defines a circular cylindrical bore having a longitudinal axis and a substantially uniform cross section transverse to the longitudinal axis, the circular cylindrical bore extending from an interior of the contact nose to an upper end surface substantially transverse to the longitudinal axis of the upper end, the nose body being housed in the circular cylindrical bore such that the contact nose is held slidably along the nail discharge port of the nose body, wherein the contact nose includes a leading end discharge port for guiding a nail driven from the leading end discharge port toward a work, and the leading end discharge port includes a guide portion longer than the nail.

2. The power-driven nailing machine according to claim 1, wherein the guide portion includes:

a straight guide portion formed at a leading end side of the leading end discharge port; and a tapered guide face formed above the straight guide portion and having an inner diameter gradually increasing upward, and when a leading end of the nail is driven into the work, the leading end of the nail and the head of the nail is positioned within the straight guide portion.

3. The power-driven nailing machine according to claim 1, wherein the guide portion includes:

a first tapered guide portion formed at a leading end side of the leading end discharge port; and a second tapered guide portion formed above the first tapered segment and having an inner diameter gradually increasing upward, and wherein the first tapered guide portion is tapered with an inner diameter increasing from the leading end toward second tapered guide portion.

4. The power-driven nailing machine of claim 1, further comprising a trigger for activating the driving piston.

5. The power-driven nailing machine of claim 4, wherein the contact nose is movable relative to the nose body such that in one configuration the nose body blocks movement of the contact nose so that the trigger is actuated.

6. The power-driven nailing machine of claim 1, wherein the driving piston is driven by compressed air.

7. A power-driven nailing machine adapted to drive at least one-sized nail into a work piece comprising:

a driving cylinder with a longitudinal axis, including a driving piston operable between first and second positions, the second position being spaced from the first position along the longitudinal axis and a driver having first and second ends, the first end being connected to the driving piston, the second end having a first outer dimension transverse to the longitudinal axis;

a nose body having third and fourth ends proximate the driving cylinder, the third end of the nose body being disposed between the driving cylinder and the fourth end of the nose body, the nose body including a first passage extending from the third end to the fourth end, the passage defining a first inner dimension transverse to the longitudinal axis of the driving cylinder, the first inner dimension being greater than the first outer dimension;

a contact nose having a leading end, the contact nose including a hollow member with proximal and distal ends, the hollow member defining inner and outer surfaces extending from the proximal end to the distal end, the fourth end of the nose body being circumferentially received within the proximal end of the hollow member such that the nose body is slidable relative to the hollow member between third and fourth positions, the fourth end resting on a first portion of the inner surface at the fourth position and being spaced from the first portion of the inner surface at the third position, the inner surface further including a guide portion disposed between the fourth position and the distal end, the guide portion being configured and dimensioned to form a radial enclosure about the at least one-sized nail such that the radial enclosure aligns the at least one-sized nail with the longitudinal axis of the driving cylinder before the driver pushes the at least one-sized nail out the leading end of the contact nose into the work piece; and a nail supply mechanism disposed between the driving cylinder and the fourth end of the nose body such that the nail supply mechanism supplies the at least one-sized nail to the nose body, the nail supply mechanism being configured and dimensioned to accommodate only nails having a length less than or equal to the distance measured along the longitudinal axis from the leading end of the contact nose to a farthest extent of the radial enclosure, wherein the proximal end of the hollow member comprises a first circular cylindrical bore defined by the inner surface and the fourth end of the nose body is circumferentially received within the first circular cylindrical bore.

* * * * *